US008374366B2

(12) United States Patent
Kidmose

(10) Patent No.: US 8,374,366 B2
(45) Date of Patent: Feb. 12, 2013

(54) SYSTEM AND METHOD FOR ADAPTIVE MICROPHONE MATCHING IN A HEARING AID

(75) Inventor: Preben Kidmose, Malov (DK)

(73) Assignee: Widex A/S, Lynge (DK)

( * ) Notice: Subject to any disclaimer, the term of this patent is extended or adjusted under 35 U.S.C. 154(b) by 1530 days.

(21) Appl. No.: 11/736,575

(22) Filed: Apr. 17, 2007

(65) Prior Publication Data

US 2007/0183610 A1 Aug. 9, 2007

Related U.S. Application Data

(63) Continuation-in-part of application No. PCT/DK2004/000719, filed on Oct. 19, 2004.

(51) Int. Cl.
*H04R 25/00* (2006.01)

(52) U.S. Cl. ..... 381/313; 381/312; 381/320; 381/321

(58) Field of Classification Search ..... 381/312, 381/313, 316, 320, 91, 92, 317, 23.1
See application file for complete search history.

(56) References Cited

U.S. PATENT DOCUMENTS 6,272,229 B1 8/2001 Baekgaard
6,741,714 B2 * 5/2004 Jensen ..... 381/313
2002/0041696 A1 * 4/2002 Jensen ..... 381/317
2003/0053646 A1 3/2003 Nielsen et al.
2003/0198356 A1 10/2003 Thompson
2004/0057593 A1 * 3/2004 Pedersen et al. ..... 381/321
2004/0196994 A1 * 10/2004 Kates ..... 381/320
2005/0069162 A1 * 3/2005 Haykin et al. ..... 381/312

FOREIGN PATENT DOCUMENTS

EP 1 458 216 A2 9/2004
JP 2003506937 T 2/2003
WO WO 01/69968 A2 9/2001

* cited by examiner

*Primary Examiner* — Fan Tsang
*Assistant Examiner* — Eugene Zhao
(74) *Attorney, Agent, or Firm* — Sughrue Mion, PLLC

(57) ABSTRACT

A directional hearing aid (100) comprising at least two microphones (201, 202) has means (200) for matching differences in amplitude and phase between the two microphones (201, 202). The microphone matching means (200) compare differences between measured transfer functions of the microphone signal paths at a number of frequencies during use of the hearing aid (100), compares the differences to differences at similar frequencies in a model of the transfer functions of the microphone signal paths, derives a set of parameters based on the comparison, and adjusts the parameters in order to minimize the difference in level differences between the model and the microphones (201, 202). The model is then used to match the microphones (201, 202) mutually by applying appropriate control parameters (103, 104, 105, 106) to an adaptive matching filter (108) carrying one of the microphone signals.

7 Claims, 6 Drawing Sheets

Figure 1:
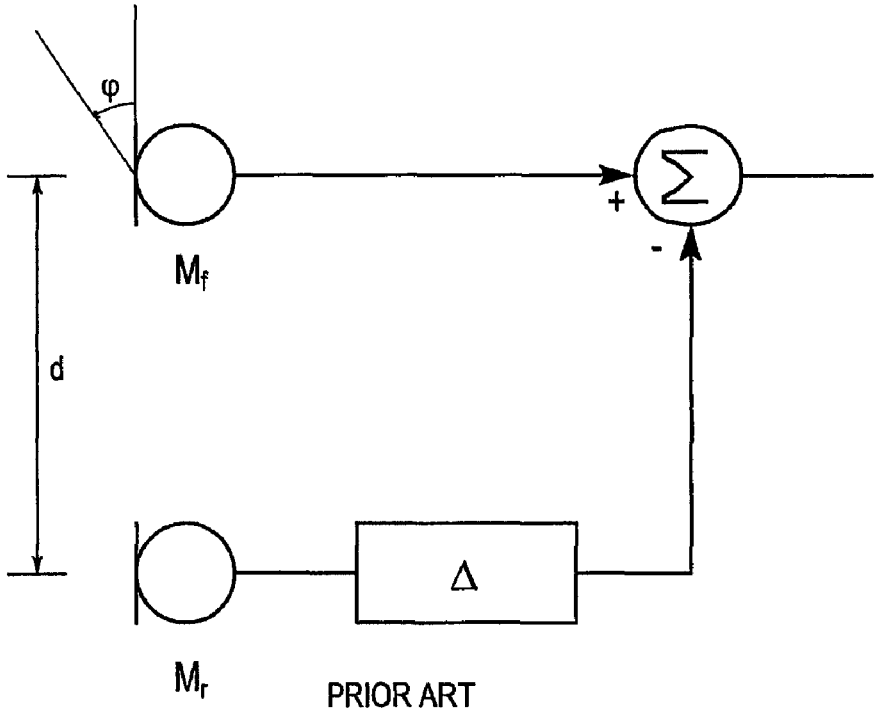

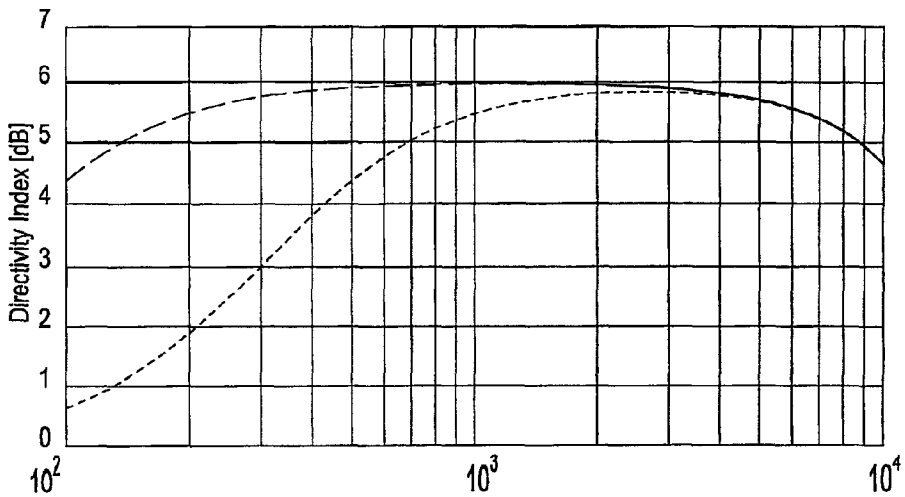
Fig. 3a
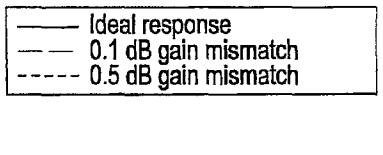
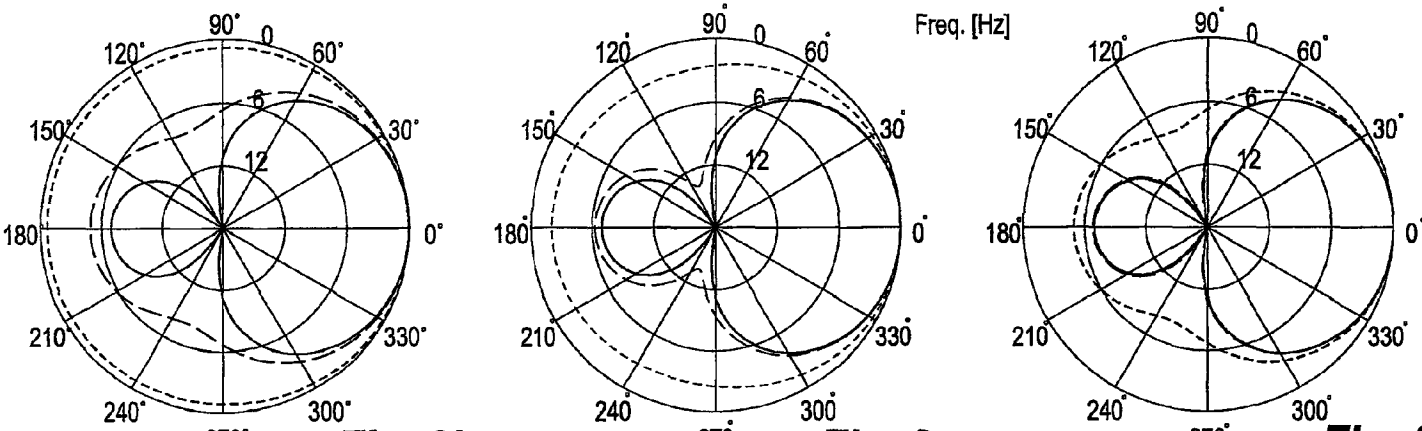
Fig. 3b
Spatial resp. [dB], Freq. = 100 [Hz]
Fig. 3c
Spatial resp. [dB], Freq. = 200 [Hz]
Fig. 3d
Spatial resp. [dB], Freq. = 500 [Hz]

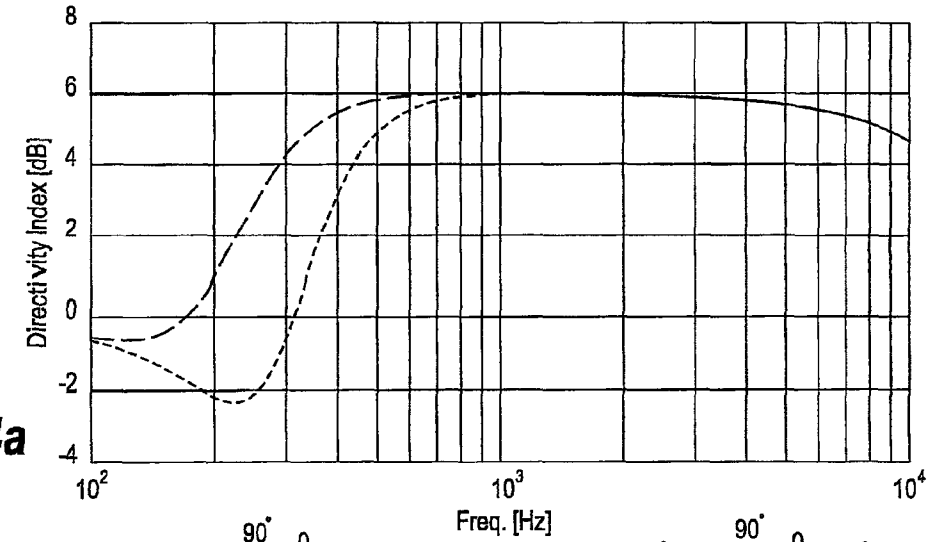
Fig. 4a
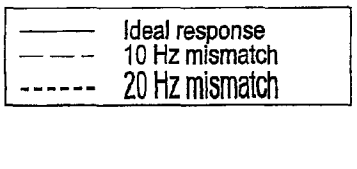
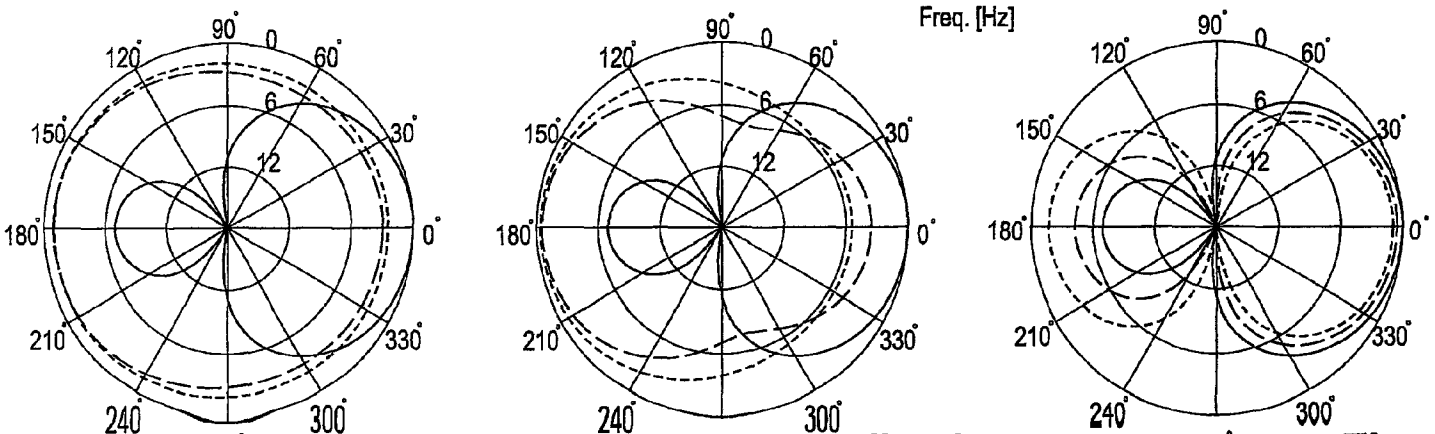
Fig. 4b
Spatial resp. [dB], Freq. = 100 [Hz]
Fig. 4c
Spatial resp. [dB], Freq. = 200 [Hz]
Fig. 4d
Spatial resp. [dB], Freq. = 500 [Hz]

SYSTEM AND METHOD FOR ADAPTIVE MICROPHONE MATCHING IN A HEARING AID

RELATED APPLICATIONS

The present application is a continuation-in-part of application No. PCT/DK2004/000719, filed on Oct. 19, 2004, in Denmark and published as WO2006/042540 A1.

BACKGROUND OF THE INVENTION

1. Field of the Invention

This invention relates to hearing aids. More specifically, it relates to digital hearing aids comprising two or more microphones in the audio signal path.

2. The Prior Art

Hearing aids with directional capabilities usually employ two or more microphones to permit the hearing aid to process incoming sounds according to direction in order to achieve increased sensitivity towards sound coming from a particular direction, or range of directions. In this process the hearing aid relies on differences in arrival time and sound level among the microphones. A hearing aid with a directional capability makes it easier for the hearing aid user to perceive a sound coming from a particular direction, as sounds from other directions are suppressed to some extent.

The term "directivity" is used throughout this application. This term signifies the capability of a hearing aid to favor sound originating from a particular direction or range of directions over sound originating from other directions. Physically, the definition of hearing aid directivity is the ratio between the output level due to sound from the favored direction and the output level due to sound averaged over the spherical integral from all directions, typically expressed in dB.

In order for a directional microphone system using omni-directional microphones to function to a reasonable degree of satisfaction it is necessary that the parameters of the individual microphones have been matched very closely to each other. The matching may be achieved in the production stage, e.g. by the careful selection of paired microphones, or, in the case of powerful digital processors, it may be achieved by adapting the processor to compensate for a difference in phase characteristics as measured individually with the particular set of microphones.

Directional microphone systems relying on arrival time differences must resolve minute differences in phase between the front and rear microphone signals in order to control the overall directional sensitivity of the combined front and rear microphone signals, especially at lower frequencies. A directional characteristic is in principle obtained by delaying the signal from the front microphone appropriately and subtracting the delayed microphone signal from the signal from the rear microphone. This requires that phase characteristics of the individual omni-directional microphones have been matched closely to each other.

From EP 1191817 A1 is known a hearing aid with adaptive microphone matching. This prior art hearing aid comprises means for comparing the signal levels from at least two microphones for the purpose of reducing the difference in the microphone signal levels. This matching only deals with differences in amplitude between the microphones, and does not take phase differences between the microphone signals into account.

US 2002/0034310 A1 describes a system for adaptively matching sensitivities of microphones in multi-microphone systems, e.g. in a directional hearing aid. The system utilizes a delay unit, a set of band-split filters, and means for scaling the microphone signals appropriately to match the sensitivities. This scaling is a band-level scaling at various frequencies only, and does not take phase differences into account.

From US 2004/0057593 A1 is known a hearing aid and a method for adaptive matching of microphones in the hearing aid. The method utilizes a feedback loop with a long time constant for matching the amplitude of the signal of the microphones. A fixed filter is used to match one of the microphones to the other microphone at manufacture, but means for changing the filter parameters at a later time are not incorporated. The matching of the microphones is not very accurate, and does not take phase variations into account.

EP 1458216 A2 describes an apparatus and a method for adapting microphones in hearing aids. The apparatus for performing microphone adaptation comprises a calibrated reference microphone, and the method of adapting the hearing aid microphone is carried out during manufacture of the hearing aid. The microphone adaptation described in EP 1 458 216 A2 does not take variations due to ageing of the microphones etc. into account.

If, during the service life of the hearing aid, the characteristics of the individual microphones change for some reason, e.g. ageing, temperature, humidity, or other factors, a matching of phase characteristics between the microphones provided in the production stage may no longer be accurate, with the potential result of a corruption of the directivity of the microphone system. This is, of course, an unacceptable situation and a need thus exists for a device or a method to keep the matching of the phase characteristics of the microphones within a certain tolerance throughout the service life of the hearing aid.

Known measures to prevent microphones from drifting over time include pre-ageing the microphones prior to assembly of the hearing aid in order to minimize drift over time during service life. Pre-ageing the microphones does not take the dependency of temperature, humidity or other environmental factors into account.

However, changes in the signal path that may occur over time cannot be taken into account. These changes in the signal path may, for example, originate from changes in temperature, humidity, component ageing, the replacement of one or both microphones by repair, etc.

If the microphones are selected among types of microphones with a frequency pole placed in the very low end of the frequency spectrum, e.g. 20-40 Hz, any differences in microphone poles essentially only affect the amplitude of the transfer function since any effects on the phase will only have effect at frequencies below the frequency range where the directional microphone system has to function.

Unfortunately, very low-frequency poles in a microphone mean that the microphone itself has a very high sensitivity in the vicinity of the pole, i.e. the range 20-40 Hz in the example in the foregoing. In a hearing aid, a high sensitivity to low frequencies in the microphones creates problems in many situations. Low frequencies are, for instance, not needed for conveying the perception of speech, and are thus in hearing aids considered unwanted signals. Low frequency noise sources nevertheless occur in many situations in modern society, e.g. when driving an automobile, or when exposed to wind noise in the outdoors. Microphones with a high sensitivity to low frequencies are easily brought into a state of saturation or acoustic overloading, wherein the microphone diaphragm itself reaches the limits of its suspension by the movements inflicted by the low frequency air pressure variations. When saturated, the microphone is prohibited from conveying sound efficiently, and a listener gets the impression that the sound has been suddenly cut off, or at least severely distorted.

Microphones having less sensitivity to low frequencies are thus to be preferred in hearing aids. However, this means poles at somewhat higher frequencies, and thereby rising importance of an accurate matching of phase characteristics.

The prior art methods of matching are either not sufficiently accurate, or they are unfit for matching any microphones but those having low-frequency poles. If microphones having less sensitivity to low frequencies—and thus poles placed higher in the frequency spectrum—are to be used, a more effective approach to matching the microphones is needed. This approach should preferably be independent of the placement of the poles in a given set of microphones, and thus freely allow matching of arbitrary microphones including those with poles at higher frequencies.

The system consisting of the microphone and the subsequent RC filter stage may be modeled with one of several approaches. The transfer function of the model may comprise only the most dominant pole of the system, resulting in a simple first order model, or it may take into account both the pole of the microphone itself and the pole of the RC filter stage, resulting in a more complex second order model. Utilizing a second-order model incorporating both the microphone and the RC filter stage complicates the matching process somewhat because a second-order system is more complicated, and thus takes more resources to model. On the other hand, it offers the prospect of a more refined matching, and allows an additional degree of freedom in the selection of microphones to be incorporated into the system.

To address the problem of achieving an accurate matching of both the amplitude and the phase of the microphones, an adaptive matching during use of the microphones, or ideally of the entire analog part of the signal path, must be made. This may be achieved by using an accurate matching system matching the microphones during use.

SUMMARY OF THE INVENTION

It is thus an object of the present invention to devise an adaptive real-time microphone matching system.

The invention, in a first aspect, provides a hearing aid comprising at least two microphone channels, an input converter, a signal processor, and an output transducer, each of the microphone channels comprising a microphone, wherein the signal processor comprises adaptive matching means for matching the microphone channels, means for measuring a first and a second transfer function of the microphone channels, means for generating a model of each of the first and the second transfer function of the respective microphone channels, and means for minimizing the difference between the model of the transfer functions and the measured transfer functions of the respective microphone channels by suitably controlling the adaptive matching means. In this way, countermeasures may be taken against mismatched microphones in a hearing aid when in use.

As the poles of both the microphones and the RC filter stages may be placed freely at design time, i.e. the poles of the microphone may be selected to lie at e.g. 200 Hz and the RC filter stage may be selected to lie at e.g. 100 Hz, the problem of driving the microphones into saturation at lower frequencies is thus also reduced, and matching of the microphones may be carried out at the discretion of the processor and its requirements, e.g. every tenth of a second, in order to keep the microphones matched—and thus the directivity index intact—during use of the hearing aid in directional mode.

The matching of a multiple microphone system is inherently a blind identification problem, i.e. based solely on the output signals from the system. The method that forms the basis of the invention comprises deriving a parametric model of the microphone system and subsequently matching the amplitude characteristic of the derived model at a number of selected frequencies. The derivation of the parametric model for a two-microphone hearing aid system may, with trivial modifications, be generalized to a system with more than two microphones. The theoretical basis for the method will be discussed in more detail in the following.

A suitable continuous-time model of the transfer function from the microphone to the A/D-converter may be described by equations (1) and (2):

$$H_f(s) = K_f \frac{s}{s + p_{mic,f}} \cdot \frac{s}{s + p_{rc,f}} \tag{1}$$

$$H_r(s) = K_r \frac{s}{s + p_{mic,r}} \cdot \frac{s}{s + p_{rc,r}} \tag{2}$$

Where $p_{mic,f}$, $p_{rc,f}$, $p_{mic,f}$, $p_{mic,r}$ and $p_{rc,r}$ are the poles of the microphones and the accompanying RC-circuit, respectively, and $K_f$ and $K_r$ are the gain values for the front and rear microphones, respectively. It should be stressed, however, that the description of the transfer function is not limited to this specific model. Using the matched pole-zero method (see for instance: Franklin et al., "Feedback Control of Dynamic Systems", Stanford University, California) to obtain the discrete-time model yields:

$$H_{f,model}(z) = K_f \frac{1 - z^{-1}}{1 - a_{mic,f} z^{-1}} \cdot \frac{1 - z^{-1}}{1 - a_{rc,f} z^{-1}} \tag{3}$$

and $$H_{r,model}(z) = K_r \frac{1 - z^{-1}}{1 - a_{mic,r} z^{-1}} \cdot \frac{1 - z^{-1}}{1 - a_{rc,r} z^{-1}} \tag{4}$$

where $a_{mic,f}$, $a_{rc,f}$, $a_{mic,r}$ and $a_{rc,r}$ are the discrete-time poles of the microphones and RC-circuit for the front- and rear-microphones, respectively, and $K_f$ and $K_r$ are the discrete gain values.

The power spectrum of the microphone models may be described by equations (5) and (6):

$$|H_{f,model}(\omega)|^2 = K_f^2 \frac{2 - 2\cos(\omega)}{d_{mic,f}(\omega)} \cdot \frac{2 - 2\cos(\omega)}{d_{rc,f}(\omega)} \tag{5}$$

$$|H_{r,model}(\omega)|^2 = K_r^2 \frac{2 - 2\cos(\omega)}{d_{mic,r}(\omega)} \cdot \frac{2 - 2\cos(\omega)}{d_{rc,r}(\omega)} \tag{6}$$

where $$d_{mic,f}(\omega) = 1 - 2a_{mic,f}\cos(\omega) + a_{mic,f}^2 \tag{7}$$

$$d_{rc,f}(\omega) = 1 - 2a_{rc,f}\cos(\omega) + a_{rc,f}^2 \tag{8}$$

$$d_{mic,r}(\omega) = 1 - 2a_{mic,r}\cos(\omega) + a_{mic,r}^2 \tag{9}$$

and $$d_{rc,r}(\omega) = 1 - 2a_{rc,r}\cos(\omega) + a_{rc,r}^2 \tag{10}$$

In order to match the rear microphone in the digital domain, the following filter is applied to the rear microphone signal path:

$$\frac{H_{f,model}(z)}{H_{r,model}(z)} = \frac{K_f}{K_r} \cdot \frac{1 - a_{mic,r} \cdot z^{-1}}{1 - a_{mic,f} \cdot z^{-1}} \cdot \frac{1 - a_{rc,r} \cdot z^{-1}}{1 - a_{rc,f} \cdot z^{-1}} \tag{11}$$

In order for the system to be able to determine how much the power spectrum of the front and rear microphone signals differ from the estimated power spectrum, an error function describing this difference is chosen. When selecting a particular error function, it is necessary to strike the correct balance between accuracy and computational speed and simplicity with respect to the different parameters. A suitable error function for this purpose is:

$$e(\omega) = p_{ratio}(\omega)\frac{1}{K^2}\cdot\frac{d_{mic,f}(\omega)}{2-2\cos(\omega)}\cdot\frac{d_{rc,f}(\omega)}{2-2\cos(\omega)} - \frac{d_{mic,r}(\omega)}{2-2\cos(\omega)}\cdot\frac{d_{rc,r}(\omega)}{2-2\cos(\omega)} \tag{12}$$

where $$p_{ratio}(\omega) = \frac{|H_{f,signal}(\omega)|^2}{|H_{r,signal}(\omega)|^2} \tag{13}$$

is the power ratio spectrum between the front and rear microphone, $$|H_{f,signal}(\omega)|^2 \tag{14}$$ and $$|H_{r,signal}(\omega)|^2 \tag{15}$$

the power spectrum of the front and rear microphone signals, respectively, and $K=K_f/K_r$ is the gain ratio between the front and the rear model.

A preferred parameterization of the transfer function model of the front and rear microphones yields:

$$H_{f,model}(z) = K_f\frac{1-z^{-1}}{1-(a_{miccenter}+a_{micdiff})\cdot z^{-1}}\cdot\frac{1-z^{-1}}{1-(a_{rccenter}+a_{rcdiff})\cdot z^{-1}} \tag{16}$$

and $$H_{r,model}(z) = K_r\frac{1-z^{-1}}{1-(a_{miccenter}-a_{micdiff})\cdot z^{-1}}\cdot\frac{1-z^{-1}}{1-(a_{rccenter}-a_{rcdiff})\cdot z^{-1}} \tag{17}$$

where $a_{micf} = (a_{miccenter} - a_{micdiff})$ and $a_{micr} = (a_{miccenter} - a_{micdiff})$.

Equations (16) and (17) are identical to equations (3) and (4) except for the fact that the parameterization has changed as the transfer function now depends on a parameter describing the center (arithmetic mean) between the two poles of the microphones, $a_{miccenter}$, and a parameter describing the difference between the front microphone and the center, $a_{micdiff}$. This parameterization turns out to be more advantageous to use in the practical case. For convenience, the parameters in (16) and (17) may be expressed as a parameter vector $$\theta=[a_{mic,center}\ a_{mic,diff}\ a_{rc,center}\ a_{rc,diff}\ K]^T \tag{18}$$

The purpose of the calculation is to estimate the parameter vector θ based on measurements of $p_{ratio}(\omega)$ at N different frequencies, $\omega_n$ for n=1 . . . N. Defining a cost function J, the problem may thus be formulated as a nonlinear least square problem on the form:

$$J = \frac{1}{2}e^T e,\ \min_\theta J \tag{19}$$

for which type of problem a plurality of efficient optimization solution algorithms exist in the literature.

Using a simple gradient based method the update equation for the estimate of the parameter vector θ thus becomes:

$$\theta_{k+1} = \theta_k - \mu\frac{\partial J}{\partial\theta} = \theta_k - \mu\frac{\partial e^T}{\partial\theta}e \tag{20}$$

The derivative of the error vector e(ω) thus forms a 5×N gradient matrix, and the derivatives of the elements of the error vector e(ω) with respect to the parameter vector θ in equation (18) are:

$$\frac{\partial e(\omega_n)}{\partial a_{miccenter}} = \frac{2}{(2-2\cos\omega_n)^2}\left(p_{ratio}\frac{1}{K^2}(a_{mic,f}-\cos\omega_n)d_{rc,f} - (a_{mic,r}-\cos\omega_n)d_{rc,r}\right) \tag{21}$$

$$\frac{\partial e(\omega_n)}{\partial a_{micdiff}} = \frac{2}{(2-2\cos\omega_n)^2}\left(p_{ratio}\frac{1}{K^2}(a_{mic,f}-\cos\omega_n)d_{rc,f} - (a_{mic,r}-\cos\omega_n)d_{rc,r}\right) \tag{22}$$

$$\frac{\partial e(\omega_n)}{\partial a_{rccenter}} = \frac{2}{(2-2\cos\omega_n)^2}\left(p_{ratio}\frac{1}{K^2}(a_{rc,f}-\cos\omega_n)d_{mic,f} - (a_{rc,r}-\cos\omega_n)d_{mic,r}\right) \tag{23}$$

$$\frac{\partial e(\omega_n)}{\partial a_{rcdiff}} = \frac{2}{(2-2\cos\omega_n)^2}\left(p_{ratio}\frac{1}{K^2}(a_{rc,f}-\cos\omega_n)d_{mic,f} - (a_{rc,r}-\cos\omega_n)d_{mic,r}\right) \tag{24}$$

$$\frac{\partial e(\omega_k)}{\partial K} = -\frac{2}{(2-2\cos\omega_n)^2}p_{ratio}\cdot\frac{1}{K^3}\cdot d_{mic,f}\cdot d_{rc,f} \tag{25}$$

The equations (21) through (25) describe the error vector for the discrete frequencies n=1, . . . ,N and forms the 5×N gradient matrix used in equation (20). The parameters $d_{mic,f}$, $d_{rc,f}$, $d_{mic,r}$, $d_{rc,r}$ and $p_{ratio}$ are dependent on $\omega_n$, too, but these dependencies are omitted for notational convenience.

This model estimation forms the theoretical basis of the microphone matching system in the hearing aid according to the invention.

According to an embodiment, the models of each of the power transfer functions of the respective microphone channels comprise models of the microphone power transfer functions and models of the first-order high pass filter power transfer functions, respectively. The model is used by the hearing aid processor in order to adapt the gain and phase characteristics of the input of one of the two microphones based on the signals from the microphone inputs and the results from equations (20) to (25). The means for calculating the set of filter coefficients for the matching filter, equation (11), utilizes the results of equation (20) to derive the filter coefficients.

The invention, in a second aspect, provides a method for matching two or more microphones in a hearing aid, including the steps of generating a model of the transfer function of a predetermined signal path, measuring the power function of the actual signal path of the individual microphones, comparing the measured transfer function to the modeled transfer function, deriving a set of parameters based on the comparison, and using the derived set of parameters to match the microphone signal paths according to the generated model.

This method may beneficially be carried out automatically by a dedicated portion of the signal processor in the hearing aid, adapting the matching of the microphone signals at regular intervals while performing other common hearing aid processing tasks.

In a preferred embodiment of this method, the amplitude of the microphone signals are measured at six selected frequencies, e.g. 80 Hz, 112 Hz, 159 Hz, 225 Hz, 318 Hz, and 450 Hz. The model of the microphone signal path is then calculated at the same six frequencies, and the difference between the measurement and the model is used in deriving the parameters used to match the microphones in the hearing aid.

The invention, in a third aspect, provides a method for matching two microphone channels in a hearing aid, each microphone channel being adapted to convert an acoustic input into a processor input signal, the method comprising generating a model of the transfer function of each of said microphone channels, measuring the power spectrum ratio between said processor input signals, comparing the measured power spectrum ratio to the modeled transfer functions, deriving a set of parameters based on the comparison, and applying the derived set of parameters to a matching filter by which to adjust the gain of at least one of said processor input signals so as to match the microphone channels.

Figure 2:
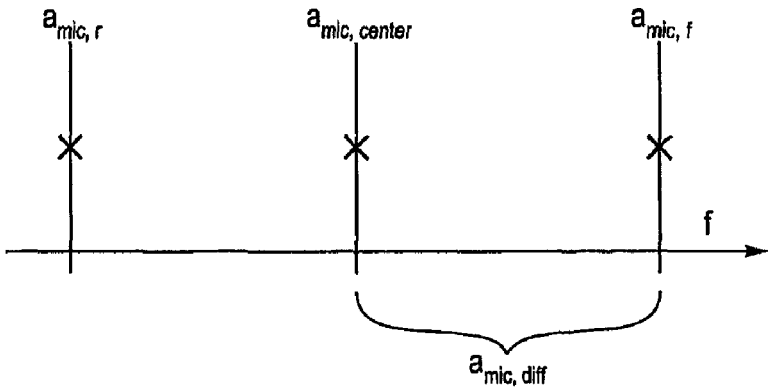
Figure 5A:
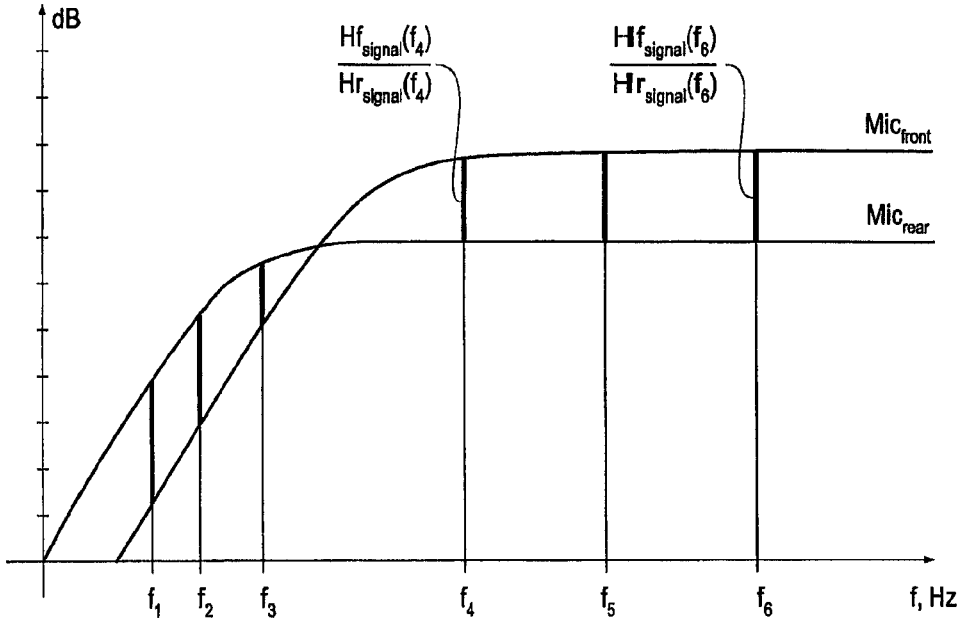
Figure 5B:
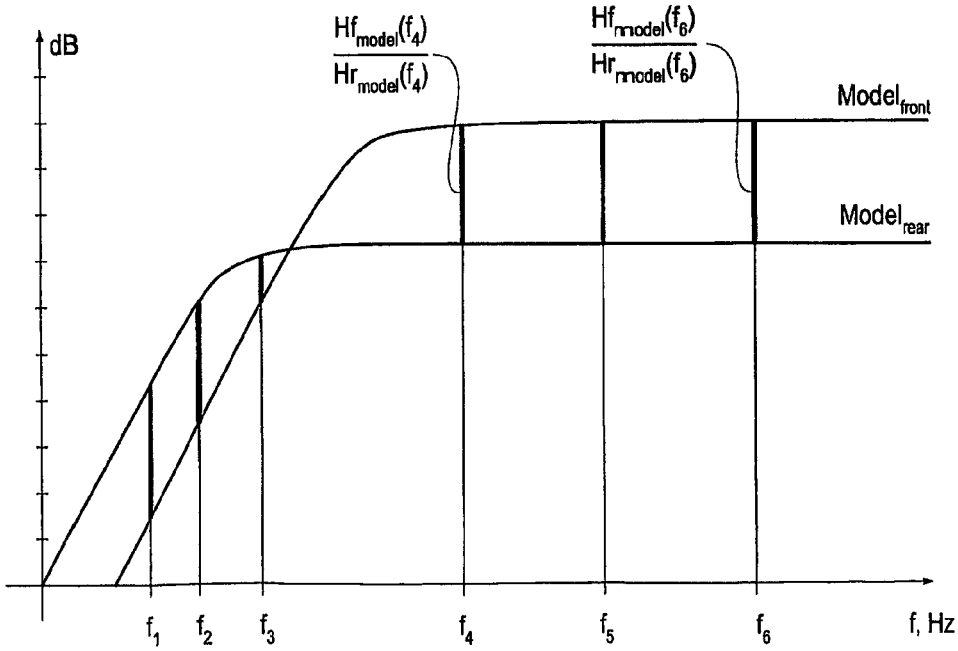
Figure 6:
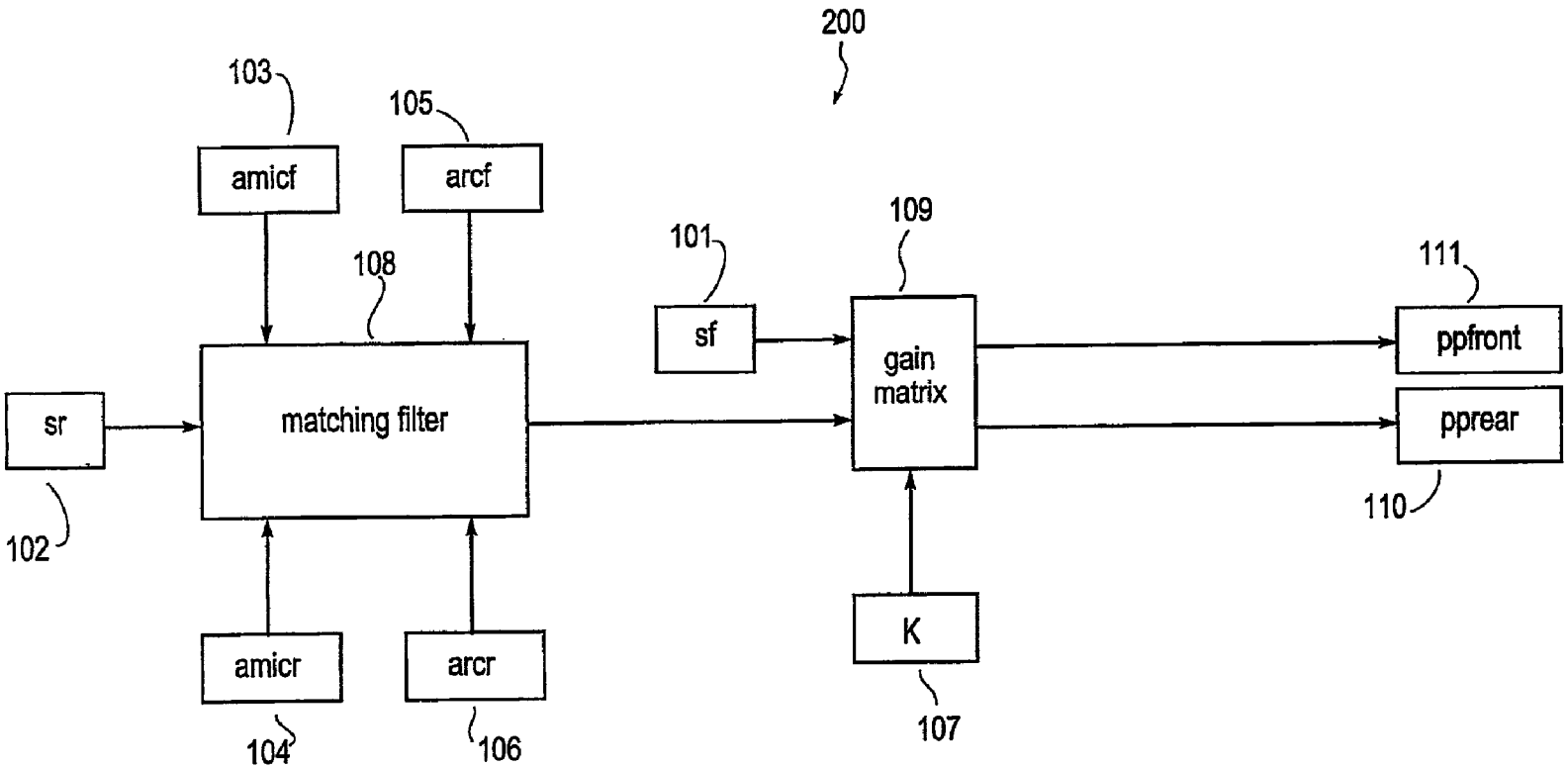
Figure 7:
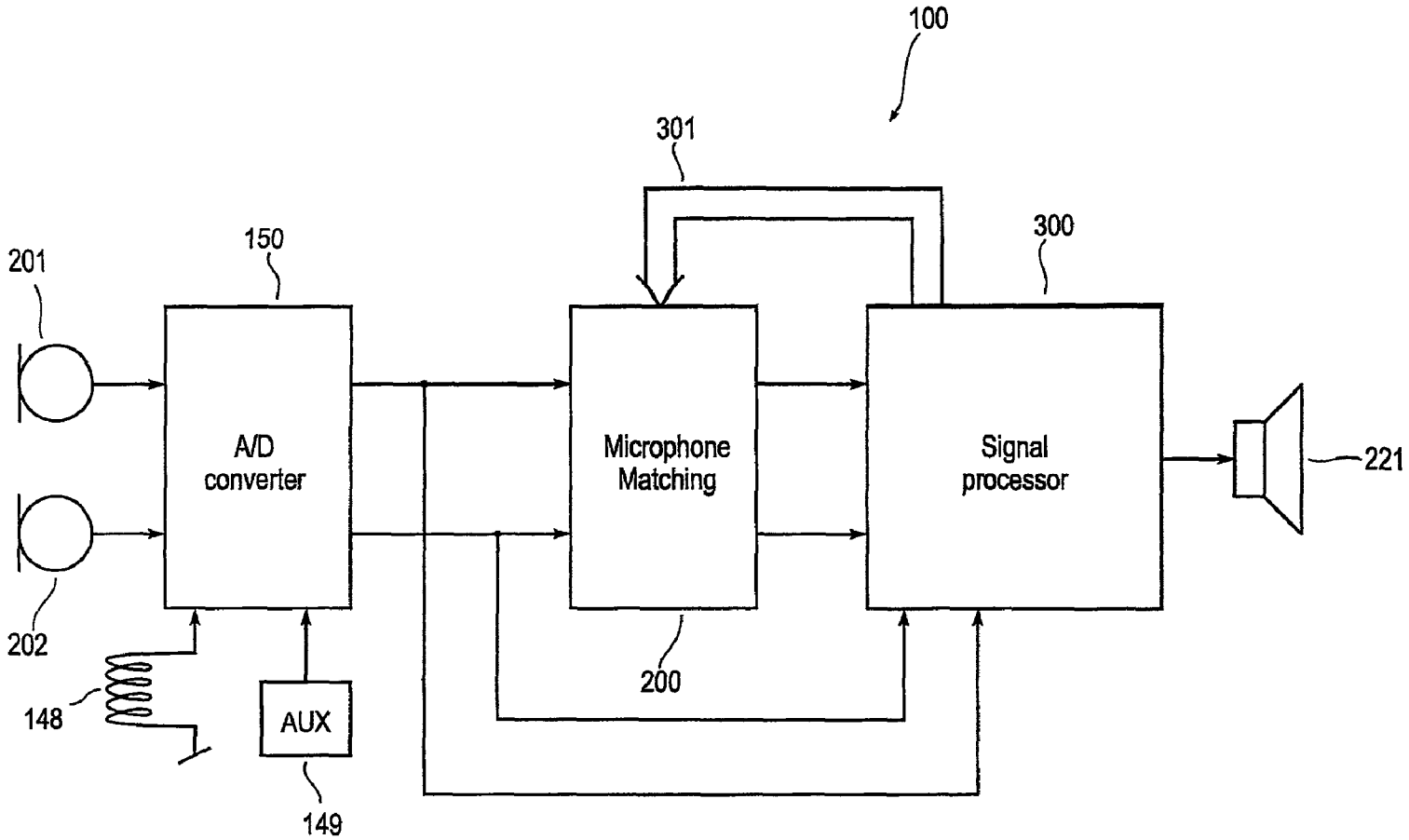

The invention will now be described in more detail with reference to the drawings, where FIG. 1 is a schematic of the working principle of a prior art directional microphone system, FIG. 2 is graph showing the derivation of the parameters used from the parameters available, FIG. 3*a* is a graph illustrating the directivity index dependency of the gain mismatch between the microphone signals in FIG. 1, FIG. 3*b* is a polar plot illustrating the spatial response of the microphone signals at 100 Hz at different gain mismatch levels, FIG. 3*c* is a polar plot illustrating the spatial response of the microphone signals at 200 Hz at different gain mismatch levels, FIG. 3*d* is a polar plot illustrating the spatial response of the microphone signals at 500 Hz at different gain mismatch levels, FIG. 4*a* is a graph illustrating the directivity index dependency of the phase mismatch between the microphone signals in FIG. 1, FIG. 4*b* is a polar plot illustrating the spatial response of the microphone signals at 100 Hz at different phase mismatch values, FIG. 4*c* is a polar plot illustrating the spatial response of the microphone signals at 200 Hz at different phase mismatch values, FIG. 4*d* is a polar plot illustrating the spatial response of the microphone signals at 500 Hz at different phase mismatch values, FIG. 5*a* is a graph showing the differences between a front and a rear microphone signal, FIG. 5*b* is a graph showing the differences between a front and a rear modeled signal, FIG. 6 is a block schematic of a microphone matching system according to the invention, and FIG. 7 is a block schematic of a hearing aid with a microphone matching system according to the invention.

DETAILED DESCRIPTION OF THE INVENTION

A two-microphone directional microphone system is assumed in the following discussion due to simplicity, but the method of microphone matching according to the invention may easily be applied to setups with three or more microphones as long as they are all mutually matched. The directional microphone circuit shown in FIG. 1 comprises a front microphone $M_f$, a rear microphone $M_r$ connected to a delay unit Δ, and a summation point Σ, where the delayed signal from the rear microphone $M_r$ is subtracted from the front microphone $M_f$. The delay unit Δ is delaying the signal from the rear microphone by a period equal to $$e^{-j\omega}\frac{d}{c}\cdot\cos\varphi_{notch} \tag{26}$$

where d is the distance between the two microphones, c is the speed of sound and $\phi_{notch}$ is the notch direction.

The directivity of directional microphone systems comprising omnidirectional microphones depends on a thorough knowledge of the amplitude and phase characteristics of the individual microphones, because these factors are critical when calculating the amplification gain and delay time for the signal from the rear microphone. A mismatch, i.e. an error, in gain or phase difference between the two microphones has a profound effect on the spatial response in the directional microphone system. The directivity index is a measure of the directional microphone system's ability to discriminate sounds from directions other than a preferred direction or range of directions. The directivity index D is defined as:

$$D = \frac{|G(0,0)|^2}{(1/4\pi)\int_{\theta=0}^{\pi}\int_{\phi=0}^{2\pi}|G(\phi,\theta)|^2\sin\theta\, d\phi\, d\theta} \tag{27}$$

and is expressed as the ratio between the sound level from the preferred direction and the spherically integrated sound level from any other direction, expressed in dB.

FIGS. 3*a*, 3*b*, 3*c*, and 3*d* illustrate the effects of gain mismatch on the directivity index between the microphones in a directional microphone system similar to the one shown in FIG. 1. In FIG. 3*a* a first graph, indicated with an unbroken line, shows an ideal directivity response from a closely matched, directional microphone system. In a system with two microphones, the highest obtainable directivity index is approximately 6 dB. In the case shown, the directivity index is about 6 dB up to approximately 1 kHz, falling to somewhere between 4 and 5 dB at 10 kHz. A second graph, indicated by a dashed line, indicates the directivity response in the case of a 0.1 dB mismatch in the microphone levels. In this case, the directivity index starts off at between 4 and 5 dB at 100 Hz, rises to about 6 dB at about 2 kHz, and falls to between 4 and 5 dB at 10 kHz. A third graph, indicated by a dotted line, indicates the directivity index response in the case of a 0.5 dB gain mismatch. In this case, the directivity index is as low as 0.5 dB at 100 Hz, about 5.5 dB at 1000 Hz, and falling to between 4 and 5 dB at 10 kHz. The directivity index only has a maximum value of about 5.8 dB at about 3 kHz.

From the graphs in FIG. 3*a* may be learned that even a small deviation from a matched microphone system may deteriorate the directivity index, especially in signals below 1 kHz. How this deterioration manifests itself in the spatial response may be learned from the polar plots in FIGS. 3*b*, 3*c*, and 3*d*. The polar plot in FIG. 3*b* shows the spatial response in a matched microphone system at 100 Hz, FIG. 3*c* the response at 200 Hz, and FIG. 3*d* the response at 500 Hz.

An ideal directional response is shown in FIG. 3*b* as a solid line, a 0.1 dB gain mismatch is shown in a dashed line, and a 0.5 dB gain mismatch is shown in a dotted line. FIG. 3*b* shows the directivity at 100 Hz as being deteriorated at a 0.1 dB mismatch and virtually disappearing at a 0.5 dB mismatch, the directional microphone system having in this case a spatial response resembling a single omni microphone. From FIGS. 3*b*, 3*c*, and 3*d* may be learned that the directivity index is severely degenerated from a mismatch of just 0.1 to 0.5 dB, and consequently the directivity index deteriorates as the frequency decreases.

FIGS. 4*a*, 4*b*, 4*c*, and 4*d* illustrate the effects on the directivity index of phase mismatch between the microphones in a directional microphone system similar to the one shown in FIG. 1. The phase mismatch is expressed as a deviation of the position of the poles between the microphone/RC-circuit transfer functions in Hz. In practice, due to manufacturing tolerances, the exact position of the poles cannot be known in advance, but deviation in the position of the poles have a profound impact on the phase relationship between the microphones. Usually this inherent problem is alleviated by matching the microphones prior to mounting them in the hearing aid. This may yield a hearing aid with an excellent directional performance at the beginning of its service life, but does not take component ageing or environmental impact into account.

In FIG. 4*a* a first graph, indicated with an unbroken line, shows an ideal directivity response from a ideally matched, directional microphone system. In the case shown, the directivity index is about 6 dB up to approximately 3 kHz, falling to somewhere between 4 and 5 dB at 10 kHz. In FIG. 4*a* a second graph, indicated by a dashed line, indicates the directivity response in the case of a 10 Hz phase mismatch between the microphones, i.e. a 10 Hz difference between the position of the poles in the transfer functions. In this case, the directivity index starts off at between −1 and 0 dB at 100 Hz, rises to about 6 dB at about 600 Hz, and falls to between 4 and 5 dB at 10 kHz. A third graph, indicated by a dotted line, indicates the directivity index response in the case of a 20 Hz phase mismatch. In this case, the directivity index starts approximately −1 dB at 100 Hz, falls below −2 dB at 250 Hz, rising to 6 dB at 900 Hz and falling to between 4 and 5 dB at 10 kHz.

From the graphs in FIG. 4*a* it may be learned that a phase mismatch corresponding to a distance of 10 Hz between the microphone poles deteriorates the directivity index response below 600 Hz—1 kHz considerably, and a phase mismatch of 20 Hz between the microphones deteriorates the directivity index response below 900 Hz. As shown in FIG. 4*a* the latter situation is even more severe, the directivity index falling below −2 dB at around 230 Hz.

FIGS. 4*b*, 4*c*, and 4*d* show polar plots of directional responses of microphone systems with varying degrees of phase mismatch at 100 Hz, 200 Hz and 500 Hz. The ideal directional response is shown in FIGS. 4*b*, 4*c*, and 4*d* as solid lines, 10 Hz phase mismatch of the poles in the microphone circuit is shown as dashed lines, and 20 Hz phase mismatch is shown as dotted lines. FIG. 4*b* shows the directivity at 100 Hz being deteriorated at 10 Hz mismatch, and virtually disappearing at 20 Hz mismatch, in which case the directional microphone system has a spatial response resembling an omni microphone. FIGS. 4*c* and 4*d* shows the same phenomenon at 200 Hz and at 500 Hz, respectively.

From FIGS. 4*b*, 4*c*, and 4*d* may be learned that the spatial response is severely degenerated from a phase mismatch of just 10 to 20 Hz, and that the deterioration gets worse at lower frequencies. In order for a directional microphone system to operate in a predictable way with respect to directivity and spatial response it is thus very important to match both the amplitude responses and the phase responses closely in the microphones used.

FIG. 5*a* shows graphs of the transfer function for two unmatched microphones, $Mic_{front}$ and $Mic_{rear}$, in a directional microphone system. Both transfer function graphs have a roll-off at the lower frequencies, but the poles, i.e. the point where the low-frequency roll-off starts, are different for each microphone. The gain levels are also different for the two microphones apart from the point where the curves intersect. This difference is due to the gain error and the phase error between the two microphones. Also illustrated in FIG. 5*a* is the measured difference in level between the two microphones at six different frequencies $f_1$, $f_2$, $f_3$, $f_4$, $f_5$ and $f_6$. The level differences between the transfer functions at the six frequencies is shown as broad, vertical lines and the difference at the frequencies $f_4$ and $f_6$ is indicated in FIG. 5*a*. Generally, the difference between the transfer functions may be expressed as $$\frac{H_{fsignal}(f_n)}{H_{rsignal}(f_n)} \tag{28}$$

It is not practically possible to measure the actual sound pressure level of the microphones during use. However, the difference in level in dB between the two microphones is independent of the instantaneous sound pressure level and will thus remain constant at a given frequency as this difference is only dependent on the mismatch between the two microphones.

FIG. 5*b* shows graphs of the transfer function for models of two unmatched microphones, $Model_{front}$ and $Model_{rear}$. Both transfer function graphs have a roll-off at the lower frequencies, but the poles, i.e. the point where low frequency-roll-off starts, are different for each model. The gain levels are also different for the two models apart from the point where the curves intersect. This is due to the gain error and the phase error between the two models. Also illustrated in FIG. 5*b* is the difference in level between the two models at six different frequencies $f_1$, $f_2$, $f_3$, $f_4$, $f_5$ and $f_6$. The level differences between the transfer functions at the six frequencies is shown as broad, vertical lines and the difference at the frequencies $f_4$ and $f_6$ is indicated in FIG. 5*b*. Generally, the difference between the transfer functions may be expressed as $$\frac{H_{fmodel}(f)}{H_{rmodel}(f)} \tag{29}$$

In order to obtain a working microphone matching system, the level differences taken from the modeled transfer functions for the microphones are compared to the level differences measured on the real microphone signals, and the poles and zeros of the transfer functions may then be adjusted using eq. (20) in order to minimize the difference between the level differences between the transfer functions of the real microphones and the level differences between the transfer functions of the model. This minimization results in a set of revised transfer functions with respect to poles and zeros where $$\lim_{J\to 0} \frac{H_{fmodel}(f)}{H_{rmodel}f(f)} = \frac{H_{fmic}(f)}{H_{rmic}(f)} \tag{30}$$

As shown in FIGS. 5*a* and 5*b*, the actual size and shape of the revised transfer functions of the model at the individual frequencies may be different from the measured transfer functions as long as the difference between the two sets of level differences are minimized.

FIG. 6 shows a block schematic of an embodiment of the microphone matching system 200 according to the invention. An output 101 of a front microphone (not shown) is connected to a first input of a gain matrix 109, and an output 102 of a rear microphone (not shown) is connected to the input of a matching filter 108. The output of the matching filter 108 is connected to a second input of the gain matrix 109. The microphone matching parameters 103, 105, 104, and 106, denoted amicf, arcf, amicr, and arcr, respectively, are connected to first, second, third, and fourth parameter inputs of the matching filter 108, respectively.

The gain matrix 109 has a first and a second output connected to a first and a second input of the signal processor (not shown) and the outputs are denoted ppfront and pprear, respectively. The gain matrix 109 has a third input for providing the value K (see eq. (1) and (2)) to the microphone matching system 200.

During use, the signal from the front microphone 101, sf, is fed directly to the gain matrix 109, and the signal from the rear microphone 102, sr, is fed to the microphone matching filter 108. The microphone matching filter 108 is a digital matching filter with the transfer function $$H_{matching}(z) = \frac{1 - amicr \cdot z^{-1}}{1 - amicf \cdot z^{-1}} \cdot \frac{1 - arcr \cdot z^{-1}}{1 - arcf \cdot z^{-1}} \tag{31}$$

which transfer function is applied to the signal sr from the rear microphone 102. The four filter parameters amicr, arcr, amicf and arcf, where amicr, arcr, amicf and arcf are the discrete-time poles of the microphones and RC-circuit for the front- and rear-microphones, respectively, are calculated by the signal processor (not shown) and fed to the microphone matching filter 108, determining the actual (numeric) transfer function applied to the rear microphone signal, sr.

The gain matrix 109 applies a gain greater than or equal to 1 to the input signal. If K (see eq. (1) and (2)) is greater than or equal to 1, then K is applied to the rear microphone signal via the gain matrix 109. If K is less than 1, then $K^{-1}$ is applied to the front microphone signal. This ensures that the output from the gain matrix 109 is always greater than or equal to 1.

FIG. 7 shows a block schematic of a hearing aid 100 according to the invention. A front microphone 201 and a rear microphone 202, together forming a directional microphone system, are connected to a first and a second input of an A/D converter 150 for converting the signals from the microphones 201, 202, into digital form. A telecoil 148 and an auxiliary input 149 is connected to a third and a fourth input of the A/D converter 150, respectively.

The digital microphone outputs of the A/D converter 150 are connected to a microphone matching block 200 for performing the matching of the signals from the microphones according to the invention, and the outputs of the microphone matching block 200 is connected to the inputs of a signal processor 300 for further processing of the matched microphone signals. The digital microphone outputs from the A/D converter 150 are also connected to the signal processor 300 for providing the measurement signals to be used in carrying out the method of the invention. The microphone matching system 200 is essentially the same as the microphone matching system described in FIG. 6. The output from the signal processor 300 is connected to an acoustic output transducer 221, and the signal processor 300 also comprises means 301 for providing the necessary parameter data to the microphone matching block 200 based on measurements and calculations according to the method of the invention.

When in use, sound signals are picked up by the front microphone 201 and the rear microphone 202 of the hearing aid 100 and converted into electrical microphone signals for amplification, filtering, compression etc. by the signal processor 300 of the hearing aid 100. However, before amplifying the electrical microphone signals, they need to be matched mutually in order for the hearing aid 100 to be able to reproduce directional information in the sound signals properly, as discussed previously. The electrical microphone signals are thus fed to the microphone matching system 200, where the matching of the microphone signals is carried out. The signal processing block 300 processes the matched microphone signals in accordance with hearing loss prescription parameters in order to compensate for a hearing loss and presents the thus processed, amplified signal to the output transducer 221 for acoustic reproduction.

I claim:

1. A hearing aid comprising at least two microphone channels, a signal processor, and an output transducer, each of the microphone channels comprising a respective microphone, wherein the signal processor has adaptive matching means for matching the microphone channels, means for measuring a first transfer function of the first microphone channel, and for measuring a second transfer function of the second microphone channel, means for generating a model of each of the first and the second transfer functions, means for comparing a first set of differences between the first and second transfer functions to a second set of differences between the models of the first and second transfer functions in order to derive a set of matching parameters, and means for feeding the matching parameters to the adaptive matching means so as to enable the adaptive matching means to minimize the difference between the first set of differences and the second set of differences.

2. The hearing aid according to claim 1, wherein the models of each of the first and the second transfer functions of the respective microphone channels each comprise models of the microphone transfer functions and models of the high pass filter transfer functions, respectively.

3. The hearing aid according to claim 1, wherein the signal processor comprises eans for generating a set of parameters for controlling the adaptive matching means based on a comparison of a measured transfer function and a generated power transfer function at a predetermined number of frequencies.

4. A method for matching at least two microphones in a hearing aid, including the steps of measuring the transfer functions of the actual signal paths of the individual microphones, generating a model of the difference between the transfer functions of the individual microphones and storing the model in the hearing aid, wherein the matching of the microphones involves the steps of determining a compensation function based on the transfer functions, comparing the difference between the transfer functions of the actual microphone channels to the differences between the transfer functions of the models of the microphone channels and applying the compensation function to one of the actual microphone channels, thereby minimizing the difference between the differences between the actual transfer functions of the microphone channels and the differences of the transfer functions of the model.

5. The method according to claim 4, wherein the step of measuring the transfer function involves the step of measuring the average amplitude of the microphone signal at a number of predetermined, discrete frequencies.

6. The method according to claim 4, wherein the step of deriving a set of parameters from the compared transfer functions involves the step of applying a stochastic gradient update to the transfer functions.

7. The method according to claim 4, wherein the step of matching the microphone signal paths involves the step of applying a transfer function based on the derived set of parameters to at least one of the microphone signal paths.

* * * * *